United States Patent [19]

Levene et al.

[11] Patent Number: 4,694,719

[45] Date of Patent: Sep. 22, 1987

[54] VACUUM DIE CUTTING APPARATUS

[75] Inventors: Martin M. Levene; William W. Lessard, both of Kitchener, Canada

[73] Assignee: Ontario Die Company Limited, Waterloo, Canada

[21] Appl. No.: 753,380

[22] Filed: Jul. 10, 1985

[51] Int. Cl.[4] ..... B26D 7/02

[52] U.S. Cl. ..... 83/451; 83/29; 83/55; 83/139; 83/176; 269/21

[58] Field of Search ..... 83/451, 139, 145, 146, 83/176, 128, 694, 856, 652, 653, 19, 29, 31, 55; 269/21, 22

[56] References Cited

U.S. PATENT DOCUMENTS

| | | | |
|---|---|---|---|
| 1,616,752 | 2/1927 | MacDonald | 83/451 |
| 2,217,060 | 10/1940 | Korsen | 83/55 |
| 3,294,392 | 12/1966 | Dunham | 83/451 |
| 3,850,064 | 11/1974 | Dwyer | 83/128 |
| 3,905,408 | 9/1975 | Hale | 83/451 |
| 4,312,254 | 1/1982 | Pearl | 83/451 |
| 4,480,507 | 11/1984 | Boogers | 83/451 |
| 4,543,862 | 10/1985 | Levene et al. | 83/139 |

*Primary Examiner*—E. R. Kazenske

*Assistant Examiner*—Hien H. Phan

*Attorney, Agent, or Firm*—Krass & Young

[57] ABSTRACT

A steel rule die assembly for cutting a fixed pattern in each of a plurality of stacked compressible material layers according to the shape of the steel rule including a plate member defining a support surface, a steel rule die adapted to be positioned on the support surface, and a continuous rigid frame adapted to be removably positioned on the support surface in surrounding relation to the steel rule die and pivotally secured to the plate member along one side edge of the frame so as to allow the frame to be pivoted upwardly about that side edge to allow removable and replacement of the steel rule die. Resilient sealing means are provided along the undersurface of the frame to form a continuous annular resilient seal on the bottom of the frame for sealing coaction with the plate member, airimpervious cover means are provided for covering the die and frame to define a vacuum chamber, and means are provided to exhaust air from the vacuum chamber to press the frame downwardly to sealingly compress the resilient sealing means against the plate member and compress and reduce the thickness of the stack layers prior to cutting of the layers with the steel rule.

13 Claims, 5 Drawing Figures

VACUUM DIE CUTTING APPARATUS

BACKGROUND OF THE INVENTION

Steel rule dies are commonly used for cutting cloth and cloth-like material such as natural textiles, and synthetic material such as vinyl. Steel rule dies are particularly advantageous in the repetitive cutting of specific shapes such as apparel, automobile upholstery and trim panels, and the like. In brief, a steel rule die typically comprises a base or backing board in which a slot or groove matching the pattern to be cut is sawn, and a length of steel rule embedded in the board with the sharpened exposed upper edge extending therefrom. The die is used in combination with a cutting pad and a press which may either be single-cut, progressive or increment feed.

A problem arises when it is necessary or desirable to cut relatively thick but compressible materials such as foamed-backed materials, foam rubber, waddings, battings, paddings, high pile materials, and other fluffy or spongy materials. A stack or a particularly thick single layer of such materials is sufficiently unstable that an accurate cut is often not possible using conventional techniques.

One approach to the more accurate cutting of compressible materials is disclosed in U.S. Pats. Nos. 3,790,154; 3,765,289; and 3,815,221, all assigned to Gerber Garment Technology, Inc. of Hartford, Conn. These patents, and other related patents assigned to Gerber, disclose a vacuum table which is used primarily to hold sheet material in place while it is cut by a two-axis single blade jigsaw type cutter. According to these patents, a sheet of mylar or oher air-impervious material can be placed over a stacked of compressible materials such that the vacuum table creates a vacuum under the sheet to pull downwardly on the sheet and maintain the entire stack in a stable, compressed condition during the cutting process. In a further Gerber U.S. Pat. No. 4,060,016, the jigsaw type cutter is replaced with a rotatable turret carrying a plurality of blanking dies which are selectively rotated into position and driven downwardly through the air-impervious sheet and through the stacked materials to form a stack of cut patterns corresponding to the shape of the particular blanking die selected.

In all of the patented systems, the board on which the stacked material is located must be capable of receiving the penetrations of the reciprocating knife, or the downward thrust of the blanking dies, as well as maintaining a vacuum for the principal purpose of holding the stack in place and for the secondary purpose of evacuating the volume under the air-impervious sheet.

All of these patented arrangements also suffer from the disadvantage that the air-impervious sheet is cut in the process of cutting the stacked material layers with a consequent loss of vacuum and thereby a loss of stability of the stack. And whereas certain of the Gerber patents describe means for "healing" the cut in the air-impervious sheet behind the cutting member, these healing arrangements unduly complicate the overall cutting apparatus and/or are not totally successful in preventing loss of vacuum with a consequent loss of stability of the stack.

It has been proposed to use stationary steel rule blanking or cutting dies with air-evacuation compression so as to facilitate and improve the use of such dies to cut compressible materials. These proposals have involved the use of an air-impervious cover means over a stack of compressible material positioned on the steel rule upper edge to define a vacuum chamber and means for evacuating the vacuum chamber to compress and reduce the thickness of the stack of layers before cutting the layers with the rule.

It has further been proposed to support the base of the steel rule die on a die plate or die carrier and to provide a frame which surrounds the steel rule die and includes means which are operative to exhaust air from the vacuum chamber formed beneath the airimpervious cover to compress and reduce the thickness of the stacked materials prior to the cutting operation. This arrangement allows a single die plate or carrier to be used with a plurality in interchangeable steel rule dies so as to obviate the need for providing a vacuum device as a part of each steel rule die. Whereas this arrangement is cost-effective and efficient, it has the disadvantage of requiring the extremely heavy steel rule dies to be lifted into and out of their positions within the frame of the die plate or carrier. This heavy and cumbersome lifting operations slows the overall cutting process considerably and, in extreme cases, requires the use of special lifting equipment.

BRIEF SUMMARY OF THE INVENTION

The present invention is directed to the provision of an improved steel rule die assembly utilizing air-evacuation techniques.

More specifically, the present invention is directed to the provision of a steel rule die employing air-evacuation techniques in which a single die plate or carrier may be used with a plurality of different dies and in which removal and replacement of the various dies within the frame of the die plate or carrier is greatly facilitated.

The present invention is directed to a steel rule die assembly for use in cutting a fixed pattern in each of a plurality of stacked compressible material layers according to the shape of the steel rule. According to the invention, the die assembly comprises a plate defining a support surface; a steel rule die including a base member adapted to be removably positioned on the support surface and an upstanding steel rule fixed to the base member at its lower edge and having an exposed sharpened upper edge defining the fixed cutting pattern; a continuous rigid frame adapted to be removably positioned on the support surface in surrounding relations to the base member of the steel rule die; resilient sealing material secured to and extending below the bottom of the frame and extending totally and continuously around the frame to form a continuous annular resilient seal on the bottom of the frame for sealing coaction with the support surface; air-impervious cover means for covering the die and the frame and any stacked layers of compressible material overlying the upper ruled edge to define a vacuum chamber delimited by the cover means, the frame, the resilient seal, and the support surface; and means operative to exhaust air from the vacuum chamber to press the frame downwardly. The downward pressure exerted by the creation of the vacuum condition within the vacuum chamber has the effect of pressing the frame downwardly to sealingly compress the resilient seal against the support surface and the compress and reduce the thickness of the stacked layers prior to cutting the layers with the rule. This arrangement allows the frame, which is relatively light, to be removed from the support surface to allow the ready insertion of a new die when a die change is required.

According to a further feature of the invention, the frame is formed of tubular material; aperture means are provided in the frame to communicate the hollow interior of the frame with the vacuum chamber; and the vacuum means is operative to exhaust air from the vacuum chamber through the hollow interior of the frame. This arrangement provides a ready and convenient means of evacuating the vacuum chamber and provides a relatively light weight frame member which may readily be moved to allow removal and insertion of the various dies.

According to a further feature of the invention, the frame member is generally rectangular in overall configuration and hinge means are provided along one side edge of the frame member so that the frame may be pivoted upwardly about the one side edge to allow removal and replacement of the steel rule dies.

According to a further feature of the invention, handle means are provided along the side edge of the frame member opposite the hinged edge to facilitate pivotal movement about the hinged edge.

According to a further feature of the invention, releasable attachment means are also provided along the edge of the frame member opposite the hinged edge to releasably secure the frame member to the support surface.

According to a further feature of the invention, the air-exhausting means includes an exhaust conduit secured to another side edge of the frame member and communicating through that side edge with the hollow interior of the frame member.

In the disclosed embodiment of the invention, the frame member is elongated; the hinged edge of the frame member comprises one of the relatively long side edges of the frame member; the releasably secured side edge of the frame member comprises the other relatively long side edge of the frame member; and the exhaust conduit is secured to an end edge of the frame member.

DETAILED DESCRIPTION OF THE PREFERRED EMBODIMENT

Figure 1:
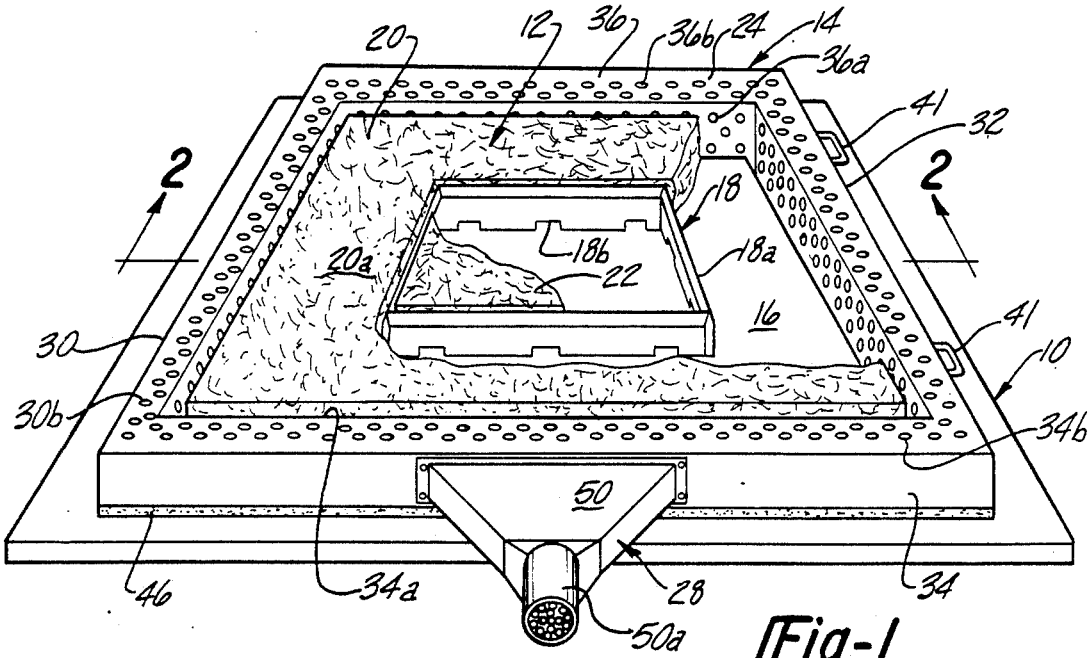
FIG. 1 is a perspective view of a steel rule die assembly according to the invention.
Figure 2:
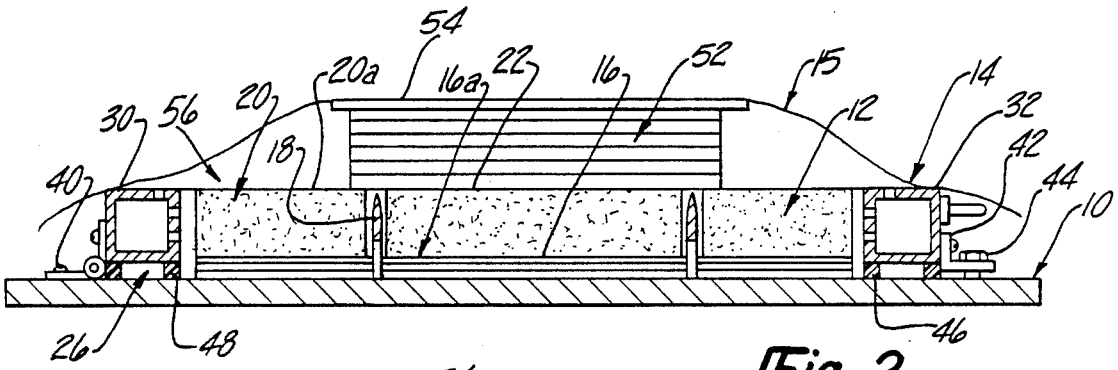
FIG. 2 is a cross sectional view taken on line 2—2 of FIG. 1.

The invention steel rule die assembly, broadly considered, comprises a plate member 10; a steel rule die 12; a frame assembly 14; and an air-impervious cover means 15.

Plate member 10 may comprise the bed plate of a cutting press or may comprise an elongated carrier plate on and by which the die assembly is moved progressively through an incremental feed press.

Steel rule die 12 includes a baseboard 16 and a steel rule 18. Baseboard 10 comprises a thick plywood board of rectangular configurations and includes a continuous slot 16*a* formed therein conforming to the desired shape of the steel rule. Steel rule 18 has a shape conforming to the shape of slot 16*a* and is driven into the slot 16*a* of baseboard 10 so that sharpened upper edge 18*a* of the rule faces upwardly. A rectangular member 20 of open-celled foam material is positioned on the upper surface 16*a* of baseboard 16. The center of member 20 is removed to form an O shaped member which extends in surrounding relation to die 18. the outer peripheral edges of open-celled foam member 20 generally correspond to the outer peripheral edges of baseboard 10 and the upper surface 20*a* of open-celled member 20 is generally at the same height as the top of sharpened upper edge 18*a* of the steel rule. Another piece of open-celled foam material 22, of generally rectangular configuration, is positioned within steel rule 18 and extends to a height approximating the top of steel rule upper edge 18*a*.

Frame assembly 14 includes a frame member 24; sealing means 26; and exhaust means 28.

Frame member 24 comprises a hollow aluminum tubular extrusion of rectangular cross section and having a rectangular overall configuration. Frame member 24 extends around baseboard 16 in surrounding relation thereto and has a rectangular size slightly greater than baseboard 16 so as to leave a small space between the side edges of baseboard 16 and the corresponding inner surfaces of frame 24. Specifically, frame member 24 is elongated and includes a side section 30; an opposite side section 32; an end section 34; and a further end section 36. A plurality of holes 30*a*, 32*a*, 34*a*, 36*a* in the inner walls of the tubular frame member communicate the interior of the frame member with the interior of the die assembly and a plurality of holes 30*b*, 32*b*, 34*b*, 36*b* in the upper walls of the frame member communicate the interior of the frame member with the area above the frame member. A plurality of hinges 38 are secured to the outer face of frame section 30 by suitable fastener members 39 and are secured to base plate 10 by suitable fastener members 40. A plurality of handles 41 are secured to the outer face of frame section 32 and a plurality of brackets 42 are secured to the outer face of frame section 32 and include slots 42*a* for coaction with threaded fastener members 44 threadably coacting with base plate 10.

Sealing means 26 comprises a pair of close-celled sponge rubber members 46, 48 adhesively secured to the underface of frame member 24 and extending totally and continuously around the underface of the frame member adjacent the outer periphery and the inner periphery of the frame member respectively.

Exhaust means 28 comprises a conduit or spout 50 secured to the outer face of frame section 34 and communicating with the hollow interior of frame section 34 and therefore with the totality of the hollow interior of frame member 24. Spout 50 includes a nozzle portion 50*a* for suitable connection to a vacuum hose communicating with a vacuum source and further includes a check valve (not shown) within the spout which closes automatically in response to removal of the vacuum hose from nozzle section 50*a*.

Air-impervious cover means 15 comprises a thin flexible air-impervious plastic shroud which is substantially larger than frame member 24 so as to be capable of extending beyond the outer edges of frame member 24.

Figure 3:
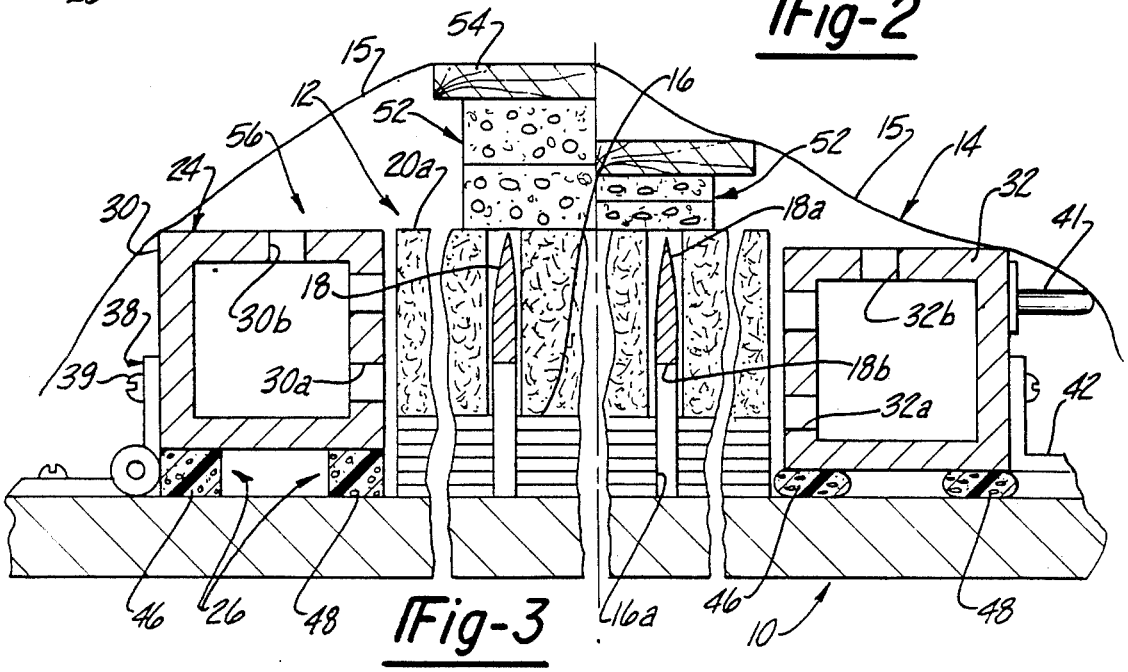
FIG. 3 is an enlarged fragmentary detail view of the cross section of FIG. 2.
Figure 4:
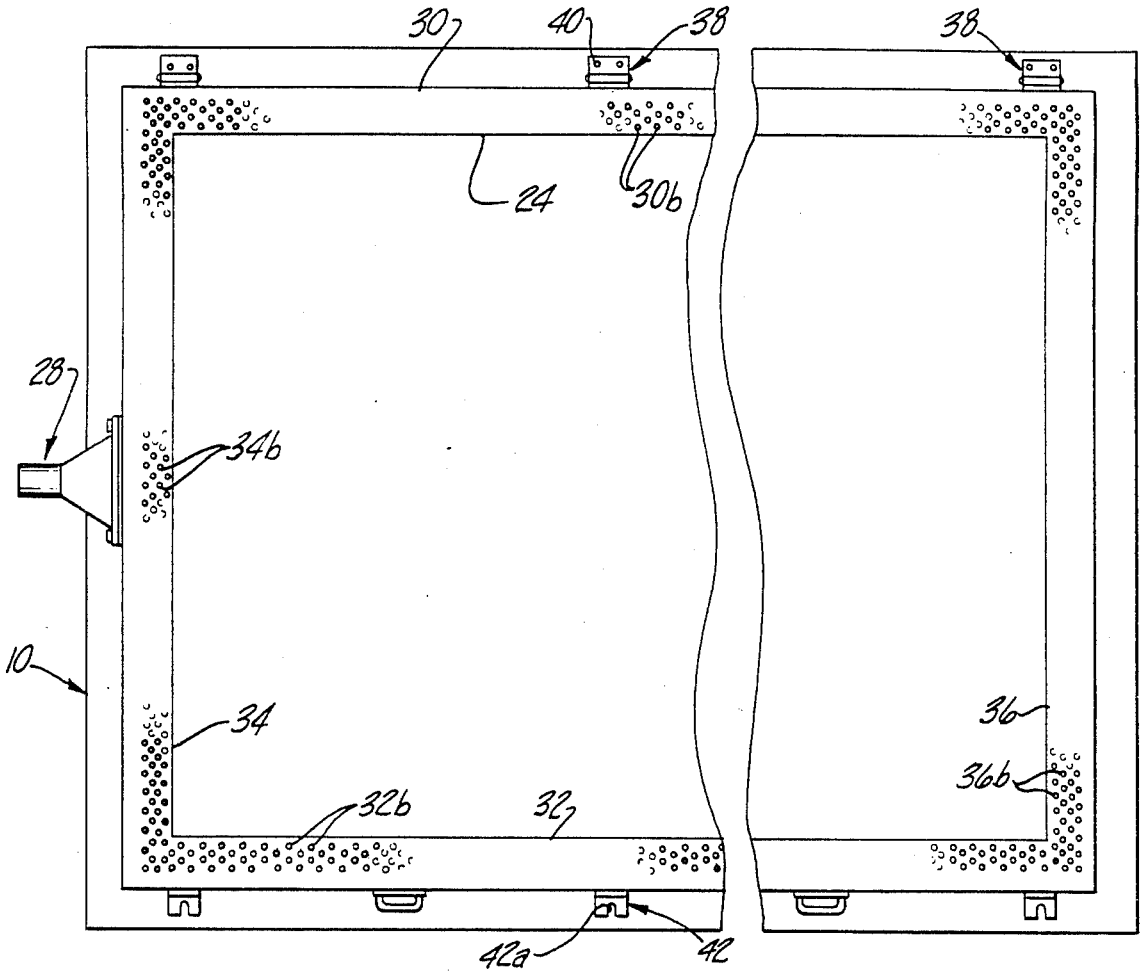
FIG. 4 is a plan view of the frame member of the invention steel rule die assembly.

In operation, with a steel rule die 12 positioned within frame member 24 and brackets 42 secured by fastener members 44, a stack 52 of compressible materials to be cut is positioned over the sharp upper cutting edge 18*a* of the steel rule 18 of the die. A cutting board 54 of rigid but relatively soft material is placed over stack 52, and shroud 15 is placed over board 54 and over frame 24 to define a vacuum chamber 56 delimited by the shroud 15, frame 24, plate member 10, and resilient sealing members 46 and 48. Air is now evacuated from vacuum chamber 56 by withdrawing air through spout 50. Specifically, air is withdrawn from vacuum chamber 56 via open cell foam members 20 and 22, via the openings 18*b* in steel rule 18, via the openings in the walls of the frame member sections, via the hollow interior of the frame member, via spout 50, and via the vacuum hose connected to spout 50. As air is evacuated from vacuum chamber 56 to reduce the pressure within the vacuum chamber, shroud 15 is pulled downwardly so that the height of stack 34 is significantly compressed and reduced whereafter the upper press platen (not shown) is operated to drive the stack 52 down over the steel rule 18 until all of the layers of material in the stack have been cut by the steel rule. Board 54 functions during the evacuation and compression process to ensure that no significant horizontal compression takes place in the stack so that the finished cut parts are accurate and uniform when they return to their normal uncompressed state after being cut. As the air is withdrawn from vacuum chamber 56 and shroud 15 is pulled downwardly, frame member 24 is also pressed downwardly against plate member 10 to compress the open-celled resilient sealing members 46 and 48 and provide a tight seal along the entire periphery of the frame member so as to maintain the vacuum condition within the vacuum chamber. The uncompressed and compressed configurations of the material stack 52 and of the resilient members 46 and 48 are shown respectively in the left and right halves of FIG. 3.

Figure 5:
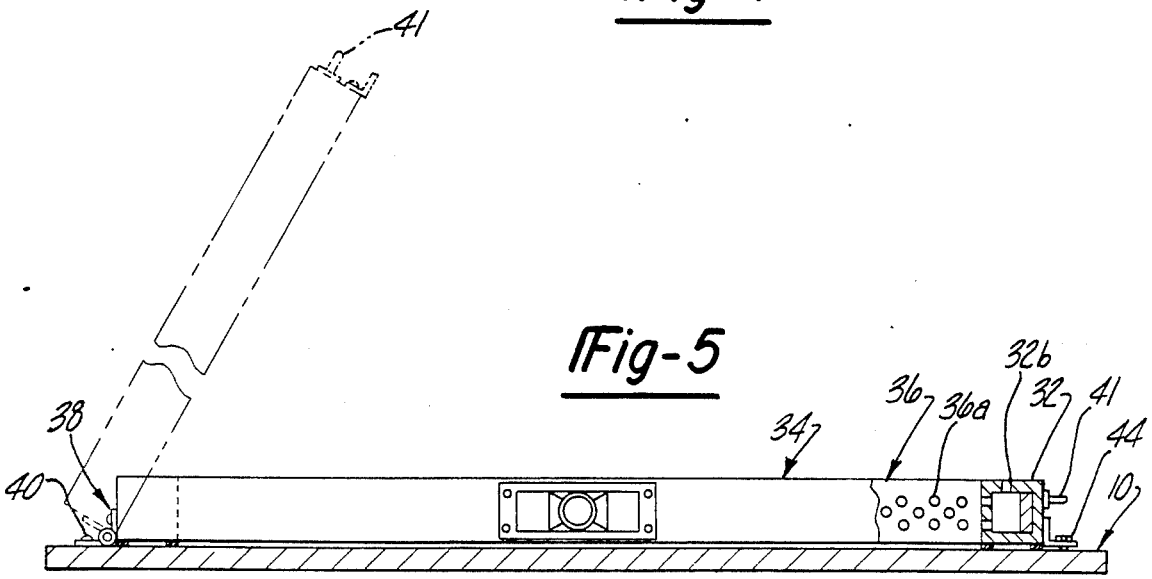
FIG. 5 is a fragmentary end view of the frame memer of the invention steel rule die assembly.

When it is desired to place a different steel rule die within frame member 24, fastener members 44 are unscrewed from the base plate and handle members 41 are grasped to pivot the frame member upwardly about hinges 38 to the dotted line position seen in FIG. 5. Steel rule die 12 is now removed in a simple sliding operation, not requiring any specialized lifting equipment, and is replaced in a similar simple sliding operation by another but different die intended to accomplish a different die cutting operation. Once the new steel rule die is in place on plate member 10, frame member 24 is pivoted downwardly about hinge members 38 to the solid line position of FIG. 5 whereafter fastener members 44 are screwed into base plate 10 to again secure the frame member to the plate member in preparation for a die cutting operation.

The invention steel rule die assembly will be seen to provide a means for accurately cutting even very high and very unstable stacks of compressible materials and further provides a ready means of quickly and efficiently removing and replacing steel rule dies.

Whereas a preferred embodiment of the invention has been illustrated and described in detail, it will be apparent that various changes may be made in the disclosed embodiment without departing from the scope or spirit of the invention.

We claim:

1. A steel rule die assembly comprising:

(a) a plate;

(b) a steel rule die adapted to be removably positioned on said plate and including a base member and a steel rule upstanding from said base member and having a sharpened upper edge;

(c) a frame member of closed loop configuration and having a size to fit on said plate in surrounding relation to said base member of said steel rule die;

(d) resilient sealing means positioned on the underside of said frame member and extending in a closed loop totally around the underside of said frame member for sealing coaction with said plate; and (e) means mounting said frame member for movement between (1) an operative position in which it is positioned on said plate in surrounding relation to said steel rule die with said resilient sealing means sealingly coacting with said plate and (2) a die change position in which it is removed from said plate to allow removal and replacement of said steel rule die.

2. A steel rule due assembly according to claim 1 wherein:

(f) said die assembly further includes an air-impervious cover adapted to cover said die and said frame and any material overlying said sharpened upper edge of said steel rule.

3. A steel rule die assembly according to claim 2 wherein:

(g) said cover defines a vacuum chamber with said plate, said frame member, and said resilient sealing means; and (h) said die assembly further includes means for exhausting air from said vacuum chamber.

4. A steel rule die assembly according to claim 3 wherein:

(i) said frame member is tubular and defines a hollow interior; and (j) said exhausting means includes means exhausting air from said vacuum chamber through said hollow interior of said frame member.

5. A steel rule die assembly for cutting a fixed pattern in each of a plurality of stacked compressible material layers according to the shape of the steel rule, said die assembly comprising:

(a) a plate member defining a support surface;

(b) a steel rule die including (1) a base member adapted to be removably positioned on said support surface and (2) an upstanding steel rule fixed to said base member at its lower edge and having an exposed, sharpened upper edge defining the fixed cutting pattern;

(c) a continuous rigid frame movable between an operative position in which it is positioned on said support surface in surrounding relation to said base member and a die change position in which it is removed from said support surface;

(d) resilient compressible sealing material secured to and extending below the bottom of said frame and extending totally and continuously therearound to form a continuous annular resilient seal on the bottom of said frame for sealing coaction with said support surface when said frame is in its operative position;

(e) air impervious cover means for covering said die and said frame and any stacked layers of compressible material overlying said sharpened upper rule edge to define a vacuum chamber delimited, with said frame in its operative position, by said cover means, said frame, said resilient seal, and said support surface;

(f) means operative to exhaust air from said vacuum chamber to compress and reduce the thickness of said stacked layers prior to cutting said layers with said rule; and (g) said frame member in its operative position being supported above and connected to said support surface only by said resilient sealing material so that the exhausting of air from said vacuum chamber is further operative to press said frame downwardly to sealingly compress said resilient sealing material against said support surface.

6. A steel rule die according to claim 5 wherein:

(h) said frame is formed of tubular material;

(i) aperture means are provided in said frame to communicate the hollow interior of said frame with said vacuum chamber; and (j) said operative means is operative to exhaust air from said vacuum chamber through the hollow interior of said frame.

7. A steel rule die assembly comprising:

(a) a plate;

(b) a steel rule die adapted to be removably positioned on said plate and including a steel rule having a sharpened upper edge;

(c) a frame member movably positioned on said plate in surrounding relation to said steel rule die and including resilient sealing means at the underface of said frame member for sealing coaction with said plate;

(d) an air impervious cover adapted to cover said die in said frame and any material overlying said sharpened upper edges of said steel rule and defining a vacuum chamber with said plate, said frame member, and said resilient sealing means; and (e) means for exhausting air from said vacuum chamber;

(f) said frame member being pivotally secured along one side edge thereof to said plate so as to be pivoted upwardly about said one side edge to allow removal and replacement of said steel rule die and downwardly about said one side edge to position said underface thereof adjacent said plate;

(g) said resilient sealing means including resilient means extending continuously around said underface of said frame member for sealing coaction with said plate with said frame in its downwardly pivoted position adjacent said plate.

8. A steel rule die assembly comprising:

(a) a plate;

(b) a steel rule die adapted to be removably positioned on said plate and including a steel rule having a sharpened upper edge;

(c) a tubular, generally rectangular closed loop frame member defining a hollow closed loop interior thereof and pivotally secured along one side edge thereof to said plate for movement between a lowered position in which it surrounds said steel rule die in an upwardly position to allow removal and replacement of said die;

(d) resilient means extending continuously around the bottom of said frame for sealing coaction with said plate with said frame in its lowered position adjacent said plate;

(e) an air impervious cover adapted to cover said die and said frame and any material overlying said sharpened upper edge of said steel rule and defining a vacuum chamber with said plate, said frame member, and said resilient sealing means; and (f) means for exhausting air from said vacuum chamber through said hollow interior of said tubular frame member.

9. A steel rule die assembly for cutting a fixed pattern in each of a plurality of stacked compressible material layers according to the shape of the steel rule, said assembly comprising:

(a) a plate member defining a support surface;

(b) a steel rule die including (1) a base member adapted to be removably positioned on said support surface and (2) an upstanding steel rule fixed to said base member at its lower edge and having an exposed, sharpened upper edge defining the fixed cutting pattern;

(c) a continuous closed loop tubular rigid frame of generally rectangular configuration defining a closed loop hollow interior thereof, having a closed loop underface, adapted to be removably positioned on said support surface in surrounding relation to said base member with said underface thereof in sealing relation to said support surface, and including apertures therein communicating with said hollow interior thereof;

(d) resilient sealing material secured to and extending below said underface of said frame and extending totally and continuously therearound to form a continuous annular resilient seal on the underface of said frame for sealing coaction with said support surface;

(e) air impervious cover means for covering said die and said frame and any stacked layers of compressible material overlying said sharpened upper rule edge to define a vacuum chamber delimited by said cover means, said frame, said resilient seal, and said support surface;

(f) means operative to exhaust air from said vacuum chamber through the hollow interior of said frame; and (g) hinge means along one side edge of said frame so that said frame may be pivoted upwardly about said one side edge to allow removal and replacement of said steel rule die.

10. A steel rule die according to claim 9 wherein:

(h) handle means are provided along a side edge of said frame opposite said one side edge to facilitate pivotal movement of said frame about said one side edge.

11. A steel rule die according to claim 10 wherein:

(i) releasable attachment means are also provided along said opposite side edge of said frame to releasably secure said frame to said support surface.

12. A steel rule die according to claim 11 wherein:

(j) said operative means includes an exhaust conduit secured to another side edge of said frame member and communicating through said other side edge with the hollow interior of said frame member.

13. A steel rule die according to claim 12 wherein:

(k) said frame member is elongated; and (l) said one side edge and said opposite side edge of said frame member comprise the relatively long side edges of said frame member and said other side edge comprises an end edge of said frame member.

* * * * *